United States Patent [19]

Nichols et al.

[11] Patent Number: 4,981,522

[45] Date of Patent: Jan. 1, 1991

[54] THERMALLY RELEASABLE FLAVOR SOURCE FOR SMOKING ARTICLES

[75] Inventors: Walter A. Nichols, Richmond; Harry V. Lanzillotti, Midlothian; Richard A. Thesing, Richmond; Alex S. Gergely, Powhatan; Constance H. Morgan, Midlothian; Bruce E. Waymack, Prince George; D. Bruce Losee, Jr., Richmond; John R. Hearn, Richmond; Johnny L. Miller, Richmond, all of Va.

[73] Assignee: Philip Morris Incorporated, New York, N.Y.

[21] Appl. No.: 222,831

[22] Filed: Jul. 22, 1988

[51] Int. Cl.[5] ..... A24D 1/00; A24D 1/18

[52] U.S. Cl. ..... 131/274; 131/275; 131/194; 131/335; 131/359; 131/353; 131/370; 131/375

[58] Field of Search ..... 131/359, 369, 194, 370, 131/372, 375, 353, 355, 356

[56] References Cited

U.S. PATENT DOCUMENTS

| | | |
|---|---|---|
| 27,214 | 11/1971 | Nakahara et al. . |
| 3,098,492 | 7/1963 | Wurzburg . |
| 3,219,041 | 11/1965 | Bromberg . |
| 3,404,690 | 10/1968 | Mosby et al. . |
| 3,410,279 | 11/1968 | Mosby et al. . |
| 3,447,539 | 6/1969 | Briskin et al. . |
| 3,540,456 | 5/1969 | McGlumphy et al. . |
| 3,550,598 | 6/1970 | McGlumphy et al. . |
| 3,584,630 | 6/1971 | Inskeep . |
| 3,608,560 | 9/1971 | Briskin et al. . |
| 3,643,668 | 2/1972 | Briskin et al. . |
| 3,713,451 | 1/1973 | Bromberg . |
| 3,738,374 | 6/1973 | Bennett . |
| 3,858,587 | 1/1975 | Cavelli et al. . |
| 3,885,574 | 4/1975 | Bothwick et al. . |
| 3,902,504 | 2/1975 | Owens, Jr. et al. . |
| 3,931,824 | 1/1976 | Miano et al. . |
| 4,008,723 | 2/1977 | Bothwick et al. . |
| 4,286,604 | 9/1981 | Ehretsmann et al. . |
| 4,291,711 | 9/1981 | Berger . |
| 4,333,484 | 6/1982 | Keritsis . |
| 4,341,228 | 7/1982 | Keritsis et al. . |
| 4,391,285 | 7/1983 | Burnett et al. . |
| 4,481,958 | 11/1984 | Raine et al. . |
| 4,510,950 | 4/1985 | Keritsis et al. . |
| 4,513,756 | 4/1985 | Pittman et al. . |
| 4,625,737 | 12/1986 | Keritsis et al. . |
| 4,632,131 | 12/1986 | Burnett et al. . |
| 4,655,229 | 4/1987 | Sensabaugh, Jr. et al. . |
| 4,708,151 | 11/1987 | Shelar . |
| 4,714,082 | 12/1987 | Banerjee et al. . |
| 4,724,850 | 2/1988 | Graves . |
| 4,732,168 | 3/1988 | Resce et al. . |
| 4,756,318 | 7/1988 | Clearman et al. . |
| 4,771,795 | 9/1988 | White et al. . |
| 4,793,365 | 12/1988 | Sensabaugh, Jr. et al. . |
| 4,858,630 | 8/1989 | Banerjee et al. . |
| 4,862,905 | 12/1987 | Green, Jr. et al. . |
| 4,943,941 | 3/1990 | Boyd et al. . |

FOREIGN PATENT DOCUMENTS

| | | |
|---|---|---|
| 117355 | 9/1984 | European Pat. Off. . |
| 174645 | 3/1986 | European Pat. Off. . |
| 212234 | 3/1987 | European Pat. Off. . |
| 232166 | 8/1987 | European Pat. Off. . |
| 245732 | 11/1987 | European Pat. Off. . |
| 246107 | 11/1987 | European Pat. Off. . |
| 254842 | 2/1988 | European Pat. Off. . |
| 254848 | 2/1988 | European Pat. Off. . |
| 270738 | 6/1988 | European Pat. Off. . |
| 270916 | 6/1988 | European Pat. Off. . |
| 270944 | 6/1988 | European Pat. Off. . |
| 271036 | 6/1988 | European Pat. Off. . |
| 277519 | 8/1988 | European Pat. Off. . |
| 280262 | 8/1988 | European Pat. Off. . |
| 280990 | 9/1988 | European Pat. Off. . |
| 2416876 | 9/1974 | Fed. Rep. of Germany . |
| 275420 | 8/1951 | Switzerland . |
| 1185887 | 3/1970 | United Kingdom . |
| 1431045 | 4/1976 | United Kingdom . |
| 1597106 | 9/1981 | United Kingdom . |

*Primary Examiner*—V. Millin

*Attorney, Agent, or Firm*—Robert M. Isackson

[57] ABSTRACT

A flavor source to be used as a thermally releasable flavorant for smoking articles that do not combust tobacco. The material includes tobacco particles, an aerosol precursor that forms an aerosol upon exposure to heat, and a filler material that absorbs and radiates heat to minimize the likelihood that the flavor material will ignite. The material is mixed in an extruder, extruded through a die, and cut into pellets having a substantially uniform shape. The pellets are loaded into a chamber for inclusion in a smoking article as a flavor generator.

28 Claims, 5 Drawing Sheets

THERMALLY RELEASABLE FLAVOR SOURCE FOR SMOKING ARTICLES

BACKGROUND OF THE INVENTION

This invention relates to a thermally releasable flavor source for use in smoking articles which produce substantially no smoke. More particularly, this invention relates to a tobacco-containing thermally releasable flavor source that provides the sensations associated with the smoking of tobacco without the burning of tobacco.

A substantial number of previous attempts have been made to produce a smoking article which produces an aerosol or vapor for inhalation, rather than smoke. For example, Siegel U.S. Pat. No. 2,907,686 shows a smoking article consisting of a charcoal rod and a separate carrier impregnated with flavorants and a synthetic "smoke" forming agent which is heated and volatized by the burning charcoal rod. The charcoal rod is coated with a concentrated sugar solution so as to form an impervious layer during burning. It was thought that this layer would contain the gases formed during smoking and concentrate the heat thus formed, thereby thermally releasing the flavorants.

Another smoking article, shown in Ellis et al. U.S. Pat. No. 3,258,015, employs burning tobacco in the form of a conventional cigarette to heat a metallic cylinder containing a source of nicotine, such as reconstituted tobacco or tobacco extract. During smoking, the vapors released from the material inside the metal tube mix with air inhaled through an open end of the tube which runs to the burning end of the smoking article. Ellis et al. U.S. Pat. No. 3,356,094 shows a similar smoking article in which the tube becomes frangible upon heating, so that it will break off and not protrude as the surrounding tobacco burns away.

European patent application 0 177 355 by Hearn et al. shows a smoking article which produces a nicotine-containing aerosol by heating, but not burning, a flavor generator. The flavor generator could be fabricated from a substrate material such as almumina, natural clays and the like, or tobacco filler. The flavor generator is impregnated with thermally releasable flavorants, including nicotine, glycerol, menthol and the like. Heating of the flavor generator is provided by hot gases formed as a result of the combustion of a fuel rod of pyrolized tobacco or other carbonaceous material.

Banerjee et al. U.S. Pat. No. 4,714,082 shows a variation of the Hearn et al. device which employs a short fuel element. The performance of the device is improved by maximizing heat transfer between the fuel element and the aerosol generator. This is effected by preventing heat loss by insulation, and by enhancing heat transfer between the burning fuel and the flavor generator by a metallic conductor. A spun glass fiber insulator surrounds the fuel element and aerosol generator assembly.

European Application No. 0 212 234 shows a smoking article having an aerosol generating means abutting a fuel element. The aerosol generating means is said to include a thermally stable, porous particulate substrate material, for example, carbon, tobacco, or mixtures of carbon and tobacco formed into densified spherical particles in a one step process (e.g., as described in U.S. Pat. No. Re 27,214) in a "Marumerizer" type machine. The substrate materials carry one or more aerosol forming materials and may include one or more volatile flavoring agents. The smoking article may include optionally a plug of tobacco at the mouth end of the fuel element whereby hot gases passing through the tobacco may vaporize volatile components in the tobacco without combustion.

European Application 0 254 848 shows a substrate material having a decreased retentive capacity for use as a carrier for aerosol materials, e.g., alumina or modified carbon.

The prior art devices that rely on thermally releasable flavorants have not heretofore adequately provided a flavor source for smoking articles that will provide the smoker with the taste and satisfaction that has become expected of a conventional tobacco-burning smoking article. Accordingly, there is a continuing need for a flavor source that can be heated to provide an acceptable taste comparable to a conventional smoking article without being burned. Further, there is a continuing need to provide such a flavor source containing tobacco.

SUMMARY OF THE INVENTION

It is an object of this invention to provide a process for making a thermally releasable flavor source for a smoking article in which the sensations of smoking of tobacco are achieved without the burning of tobacco.

It is a further object of this invention to provide a tobacco-containing flavorant material that can be heated to provide a flavored aerosol to the smoker.

It is another obJect of this invention to provide a tobacco-containing flavorant material having a low mass and high surface area that is adapted to optimize heat exchange for providing a flavored aerosol upon being heated.

It is another object of this invention to provide a tobacco-containing material in the form of substantially uniform pellets that can be easily processed, stored in bulk, and packaged in a flavor generator of a smoking article.

In accordance with this invention, there is provided a flavor material for use in a smoking article having a heat source that is capable of heating the flavor material to generate therefrom a flavored aerosol and/or vapor for delivery to the smoker. Broadly, the invention concerns forming a flavorant material by combining particularized tobacco, an aerosol precursor, and a finely divided filler material, thoroughly mixing the components, extruding the mixture out a die orifice into a strand, and cutting the extruded strand into lengths, preferably of uniform length, thereby forming pellets. The pellets preferably comprise a mixture of about 15 to 95% tobacco material, 5 to 35% aerosol precursor, and 0 to 50% filler material. Optionally, conventional flavoring agents may be added to the mixture prior to or subsequent to extrusion, e.g., menthol, oil of peppermint, tobacco extract, nicotine, and other tobacco flavoring agents known to those of skill in the art. In the preferred embodiment, the die contains a plurality of orifices to form a plurality of strands simultaneously at a relatively uniform flow velocity.

The extrusion conditions are such that the materials are adequately mixed at low temperatures with low shear and a minimum amount of work to provide a homogeneous mixture The extruding equipment may be any conventional extruder machine and related control apparatus such as that used in the food processing industry, including single screw extruders and preferably twin screw extruders.

In the preferred embodiment, the several ingredients are added at different locations or mixing zones along the extruder barrel mixing chamber, for example, first feeding in the aerosol precursor, adding in the filler material downstream to the aerosol precursor, and finally adding the tobacco particles and any added flavoring agents downstream of the filler material, each at a controlled feed rate. Alternately, the ingredients may be mixed in a conventional mixing device and then fed into the mixing chamber of the extruder apparatus.

The aerosol precursor preferably also acts as a lubricant to aid in reducing the work required to mix the ingredients and so to maintain the temperature of the mixing barrel at or below a selected operating temperature. In circumstances where the amount of aerosol precursor does not alone adequately lubricate the mixture, an additional lubricant may be added, e.g., water or alcohol.

In the preferred embodiment, the extrudate is maintained at a temperature below about 170° F., preferably at about 150° F. A cooling fluid may be circulated about the extruder mixing barrel to absorb heat generated during mixing. For example, a conventional heat transfer fluid, e.g., propylene glycol, at −4° C. may be used. Further, the relative proportions and feed locations of the components of the mixture, particularly of any lubricating material and other dry materials, can be adjusted to provide the desired degree of mixing and temperature inside the extruder barrel and to produce the desired pellets in accordance with the abilities of one skilled in using such extrusion apparatus.

The extruded strands are severed to form pellets having a substantially uniform surface area and a low mass. These characteristics advantageously provide efficient heat exchange with the heat source of the smoking article and improve the ability of the smoking article to generate the desired flavors. Further, the pellets are flowable and substantially incompressible, but not friable. Thus, the pellets can be stored and shipped in bulk storage containers, e.g., 50 gallon drums, without significantly damaging the pellets stored on the bottom of the container, and be withdrawn from bulk storage containers for inclusion into the smoking articles in metered amounts or continuously.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
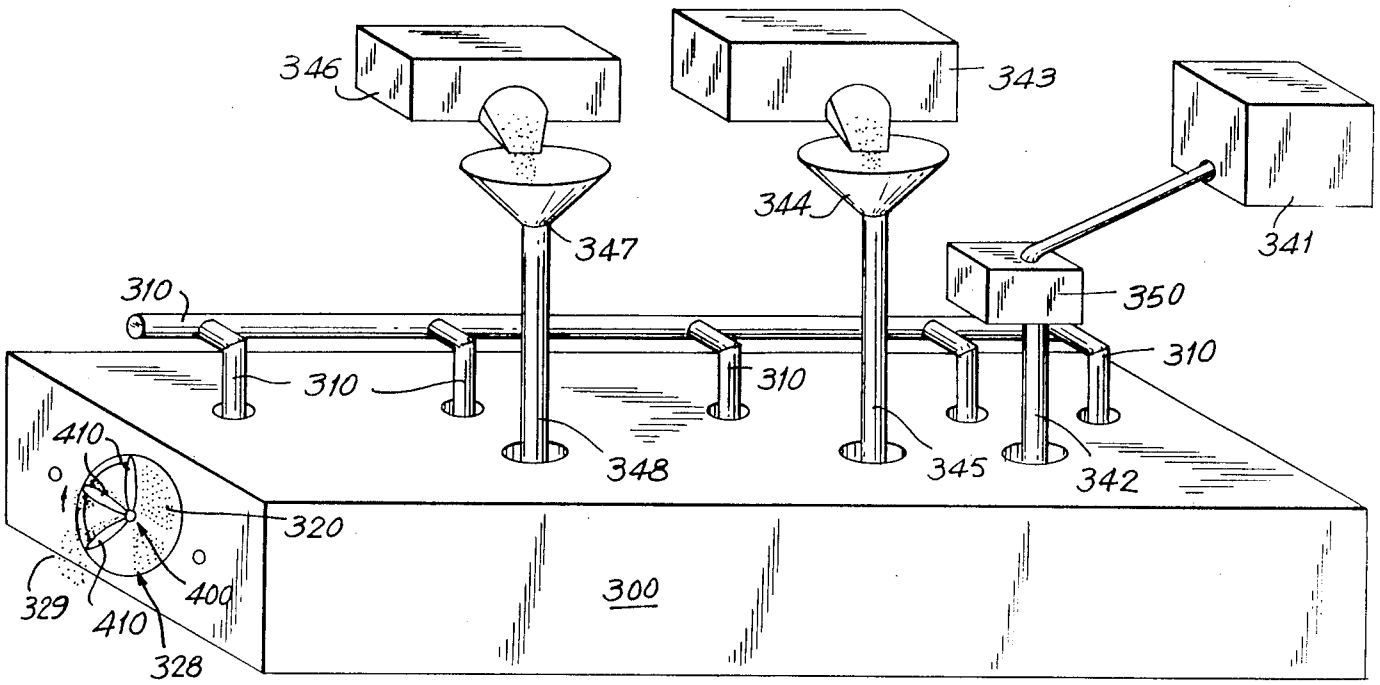
FIG. 1 is a schematic perspective view of an extruder illustrating the process of the present invention.

The pellets of this invention comprise a thermally releasable flavorant material produced by an extrusion process that provides for the homogeneous mixture of the components and a substantially uniformly sized end product. Thus, high speed mass production apparatus and techniques can be used to make and process the pellets and form thermally releasable flavor generators for smoking articles.

The tobacco material may be comminuted tobacco selected from the group consisting of bright, burley, oriental, sun-cured, air-cured bright and mixtures thereof, reconstituted tobacco, comminuted stems or tobacco dust or fines. The tobacco may have been previously subjected to a stiffening or expansion process to increase its filling power, or to other conventional tobacco treatment processes, for example, to reduce the alkaloid or nicotine content of the tobacco. Whatever the source of the tobacco particles, the particles employed in the present invention will have a particle size in the range of from about 20 to about 400 mesh, preferably about 150 mesh.

The aerosol precursor forms an aerosol upon being subjected to heat. It is a material that, during the mixing process, becomes widely dispersed among and absorbed by the tobacco particles. Advantageously, absorption by the tobacco and filler material minimizes migration or wicking of the aerosol precursor so that it remains widely dispersed. The aerosol precursor also serves as a lubricant to facilitate mixing of the components. The preferred aerosol precursor material is glycerine, preferably U.S.P. grade glycerine, added in a liquid state containing substantially no water. Other aerosol precursor materials may be selected from propylene glycol, 1,3-butanediol and the like.

The filler material aids in controlling the dessication and pyrolization of the pellets by presenting a thermal load to the heat source of the smoking article. Thus, the pellets may be subjected to gas temperatures above the ignition temperature, yet the pellets will not heat up o ignition temperature. The filler material also may reduce the ashing tendency of the pellets as they are pyrolized. The preferred filler material is calcium carbonate in a fine precipitated grade, typically about 0.8–1.0 microns in diameter. It is believed that calcium carbonate having a particle size less than about 100 mesh can be used satisfactorily. Other filler materials may be selected from inert fillers, e.g., alumina. The filler material also becomes widely dispersed among the components of the mixture by the mixing process.

The equipment for making pellets may be any conventional extruder machine and control apparatus, for example, extruders such as those used in the food processing industry. Twin screw extruders are preferred over single screw extruders because they provide more uniform mixing, a more uniform flow velocity at the die, and, hence, a more uniform product. A preferred twin screw extruder is the model MPF-50, manufactured by APV Baker, of Grand Rapids, Michigan, having a 25:1 length to diameter ratio. Extruders having smaller length to diameter ratios, e.g., of about 15:1, may be used.

Referring to FIG. 1, extruder barrel 300 has several input ports spaced along the mixing barrel for feeding materials to be mixed into the barrel. Conventional product feed apparatus may be provided for controlling the rate at which the liquid or finely divided ingredients of the pellets are added to obtain the desired proportions. For example, metering pump 350 may be used for metering the flow of a liquid aerosol precursor from supply reservoir 341 into the extruder barrel at port 342 at a rate of about 20 lbs per hour. Similarly, funnel 344 may be used for receiving and passing finely divided filler material from supply 343 into port 345 at a rate of about 25 lbs per hour, and funnel 357 may be used for receiving and passing finely divided tobacco from supply 346 into port 348 at a rate of about 55 lbs per hour. Conventional means for metering the flow of the particulate materials (not shown) may be provided.

The extruder barrel is preferably cooled in a conventional manner, e.g., by passing cooling fluids at about −4 degrees centigrade through ports 310 of extruder 305 so that the cooled fluids circulate in the jacket of the extruder barrel (not shown). The cooling fluids absorb heat generated by the mixing action and thus minimize the likelihood of the heat adversely affecting the subjective qualities of the tobacco material. It is desired that the temperature of the material be kept below 175° F., which temperature will minimize any thermal degradation of the tobacco material and further will permit the addition of flavoring agents to the extrudate in the mixing barrel. The preferred maximum temperature in the barrel is about 150° F. and the preferred minimum temperature is about 140° F. The relative proportions of the mixture, particularly the lubricant and other dry materials, and the temperature of the circulating cooling liquid can be adjusted to provide the desired temperature inside the extruder barrel. The flow rate and temperature of the cooling liquid also can be adjusted to control the temperature. Further, the extruder jacket may be divided into compartments so that different flow rates of coolant and different (or the same) temperatures can be maintained in different compartments along the mixing barrel, independently of any difference in heat being created by mixing.

Referring to FIGS. 1, *2a*, and *2b*, extruder die 320 has a plurality of orifices 325, preferably about two hundred and sixty-four orifices. Each orifice is preferably about 1.0 mm in diameter. The extruded material thus forms spaghetti-like strands 328 that are about the same diameter as the die orifices, e.g., 1.0 mm. Die 320 is preferably configured so that orifices 325 are arranged into four groupings of orifices (See FIG. *2a*). Within each grouping the orifices are spaced about the same distance apart, and the groups are separated by solid material. This grouping facilitates cutting of strands 328 into pellets 329 and minimizes pellets from interfering with the extrusion or cutting steps. Means for catching the pellets (not shown) also are provided, for example, a vibratory conveyor or a basket under the die.

It is desirable to extrude the extrudate out the die at a substantially uniform flow velocity. This will provide an extruded material that will have substantially uniform dimensional characteristics, particularly with respect to surface area. The rheology of the materials may be adjusted to provide the desired uniform flow velocity for the particular die and extrusion apparatus being applied. A flow velocity of about 100 to about 250 pounds per hour is preferred.

Referring to FIGS. 1 and *2b*, knife 400 may be placed in close proximity to and preferably in frictional contact with die orifice 320 and rotated to cut the strands as they are extruded into segments of substantially the same length, e.g., preferably in the range from about 0.5 to about 1.5 mm, thereby forming pellets of substantially uniform configuration. The strands may be cut perpendicular to the longitudinal axis of the strands or at an angle thereto, for example, to increase the surface area of the pellets. Preferably knife 400 has a plurality of blades 410, e.g., six blades. The rate at which knife 400 rotates may be in the range of from about 200 to about 1800 revolutions per minute for a flow velocity of from 100 to about 250 pounds per hour, but may be adjusted to accomodate the actual flow rate and the number of cutting edges on the knife. The cutting edges of the knife blades preferably ride on the surface of the die orifice.

The mixture in the extruder barrel and the resultant pellets have a moisture content that depends upon the OV content (as defined, for example, in U.S. Pat. No. Re 32,013) of materials being mixed together. In the preferred embodiment, the tobacco is added at about an equilibrated OV content of from about 7 to about 20% OV, and the aerosol precursor and the filler material are added in a substantially dry condition. Thus, the components of the pellets are essentially dry mixed and the pellets formed can be packaged in bulk immediately following extrusion. Flavoring agents that optionally may be added are typically provided in a liquid carrier solution of water, alcohol or propylene glycol. The carrier liquids tend to be absorbed by the tobacco or the glycerine and so disperse the flavoring agent. The amount of liquid carrier is usually not significant to affect the OV level or capacity of the pellets.

When glycerine is used as the aerosol precursor, the proportion of glycerine in the pellets effects the equilibrated OV content of the pellets because of the known propensity for glycerine to absorb water. Thus, at higher glycerine levels, e.g., at about 30 wt. % glycerine, the equilibrated OV level may be at about 18% and that might cause the pellets to be soft or sticky after they have equilibrated. In such case, the residence time of the pellets in the ambient atmosphere may be controlled so that the still hard pellets can be packaged and stored in, for example, sealed containers, prior to equilibration or significant water absorption. At lower glycerine levels, e.g., 5 wt. %, the equilibrated OV content will be at about 12%, which is sufficiently dry to permit longer residence times and may permit storage in non-airtight containers in all but the more humid of environments.

In circumstances where water or other volatile lubricant may be added to the mixture, appropriate measures may be taken to remove the lubricant or moisture to provide the hard, non-tacky pellets for use or for storage. For example, means for drying the pellets for use or for storage may be provided such as ovens (radiant, convection or microwave), subjecting the pellets to a dessicant environment, or the like.

Uniformity of the tobacco particles is important to producing pellets having consistent structural and subjective characteristics. The size of the particles added to the extruder can have an affect on the uniformity of the product. Tobacco particles that approach the size of the orifices of the die might plug orifices or adversely affect the uniformity of the extrusion, and are, therefore, undesireable. Consequently, it may be desirable to use a multistage grinding process to obtain particles of about the same size or to overgrind the particles to assure that the maximum particle size will be at or below the desired mesh limit.

Generally, the finer the grind, the firmer and more desirable the resulting pellet. One limitation on the fineness of the grind is the ability of the selected aerosol precursor or lubricant to distribute among the particles, which depends upon the characteristics of the aerosol precursor or lubricant and the size of the particles.

EXAMPLE

The following examples were extruded on the aforementioned AVP Baker extruder having a 1263.1 mm long extrusion chamber, wherein the two screws had the same assemblage of components, as follows:

| SCREW ASSEMBLY | |
|---|---|
| Length (mm) | Element(s) |
| 381 | Feed screws |
| 88.9 | Seven 30° forwarding paddles |
| 406.4 | Feed screws |
| 50.8 | Transition element |
| 19 | Die with 264 1.0 mm diameter orifices |

The APV Baker extruder has multiple feed ports along its length. The aerosol precursor was added at a distance 12:1 (length:diameter) as measured from the die orifices, the tobacco material was added at a distance 15:1 from the die, and the filler material was added at a distance 25:1 from the die. The mixtures consisted of the following components:

| Component | Weight % | Feed Rate |
|---|---|---|
| | Example 1 | |
| aerosol precursor | 15% glycerine, | 15 lbs/hr. |
| filler material | 25% calcium carbonate | 25 lbs/hr. |
| tobacco | 60% tobacco material at 150 mesh | 60 lbs/hr. |
| | Example 2 | |
| aerosol precursor | 25% glycerine, | 25 lbs/hr. |
| filler material | 25% calcium carbonate | 25 lbs/hr. |
| tobacco | 50% tobacco material at 150 mesh | 50 lbs/hr. |

These compositions produced acceptable pellets.

| Comparative Example 1 | | |
|---|---|---|
| aerosol precursor | 25% glycerine | 25 lbs/hr. |
| | 10% Water | 10 lbs/hr. |
| filler material | 25% $CaCO_3$ | 25 lbs/hr. |
| tobacco | 40% tobacco material at 150 mesh | 40 lbs/hr. |

This composition produced pellets that were too soft.

In accordance with the preferred application of the pellets, the pellets are adapted to be metered into a controlled amount and packed into a confined location (herein "chamber") in a smoking article. A typical chamber might be, for example, a cylindrical space about 8 to about 14 mm, preferably about 11 mm long by about 4 to about 8 mm in diameter and hold from about 100 to about 200 mg, preferably about 150 mg of pellets. The chamber preferably has non-porous walls along its length and is disposed between a heat source, preferably a carbon heat source capable of sustaining combustion, and a mouth-end of a smoking article. The chamber is further provided with apertures at its heat source end and at its mouth end so that radiant and convective heat from the heat source and puff-induced air drawn over the heat source will enter the chamber from the heat source and pass about the pellets and exit the chamber to the mouth-end. Preferably the pellets are loosely packed so that there is no pressure drop across the pellets. Further, the chamber may comprise a separate flavor bed having nonporous walls that can be filled with pellets and closed on each end by screens that will permit air flow and confine the pellets, thereby to form a unit to be included in a smoking article.

When the pellets are subjected to heat, the aerosol precursor will form an aerosol, and the flavor components of the tobacco and any added flavoring agent will volatize and either condense on the aerosol, form its own aerosol, or form a non-aerosol vapor for delivery to the smoker. Preferably, the temperature will be sufficient to dessicate and, more preferably as explained below, to pyrolize the pellets, thereby to release thermally its flavor components and change the pellet substantially into some degree of char, without igniting or causing combustion of the pellet, the aerosol, or any of the volatized flavor components.

The proportion or amount of aerosol precursor, and any additional lubricant, added to the mixture affects the heat capacity of the pellets and hence whether the pellets will ignite when exposed to heat at temperatures above the ignition temperature. Generally, the greater the proportion of aerosol precursor and filler material, the higher the temperature that can be used without causing ignition. However, too large a proportion of such materials may prevent adequate thermal release of the flavorants, for example, when the heat source is operated below its normal operating temperatures.

Referring to FIGS. 3–8, the pellets of the present invention may be used in an illustrative smoking article 10 having mouth end 8 and a distal end 4 remote from the mouth end, which consists of active element 11, spacer tube 12, and filter element 13, all overwrapped by magnesium oxide cigarette wrapping paper 14. Active element 11 includes a heat source 20 and chamber (or flavor bed) 21 which contains pellets 329 and releases a flavored aerosol and non-aerosol vapors when subjected to heat from heat source 20. The aerosol and non-aerosol vapors pass through spacer tube 12 to filter element 13, and thence into the mouth of a smoker.

Heat source 20 is preferably a carbon material, more preferably a substantially pure carbon with some catalysts or burn additives having a high surface area which may include a multifaceted interior passageway designed to increase the effective surface area of the source and to combust substantially all of the oxygen passing by the heat source. The heat source also may have sharp corners on the facets to increase radiant heat. Correlatively, given sufficient oxygen, carbon heat source 20 will burn to produce mostly carbon dioxide.

Active element 11 includes outer sleeve 22 which is substantially non-combustible, and does not burn during smoking of article 10. Further, pellets 329 are kept in an oxygen-deprived region of chamber 21, so that the pellets do not burn even if the aerosol is hot enough to ignite them otherwise, or if they would otherwise ignite as a result of heat radiated from heat source 20 or the heated oxygen-starved gases passing through chamber 21. Consequently, heat from heat source 20 may pyrolyze pellets 329 over the useful life of the smoking article, beginning with the pellets closest to the heat source and spreading to the pellets closest to the mouth end. Thus the gas given off by article 10 in the "mainstream 'smoke'" is mostly carbon dioxide. There is substantially no sidestream "smoke" generated when article 10 is smoked.

Figure 2B:
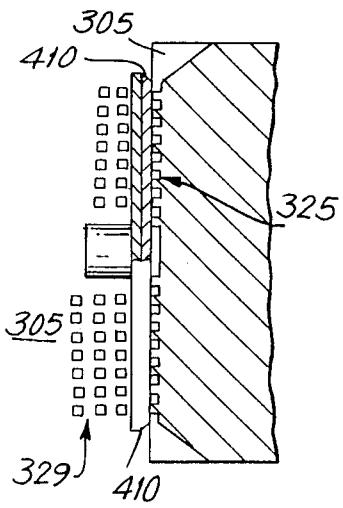
FIG. 2*b* is a side view of the extruder die of FIG. 1.
Figure 2A:
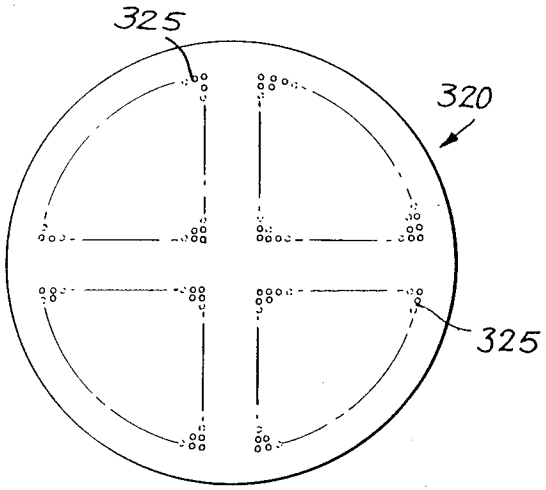
FIG. 2*a* is a front view of the extruder die of FIG. 1.
Figure 3:
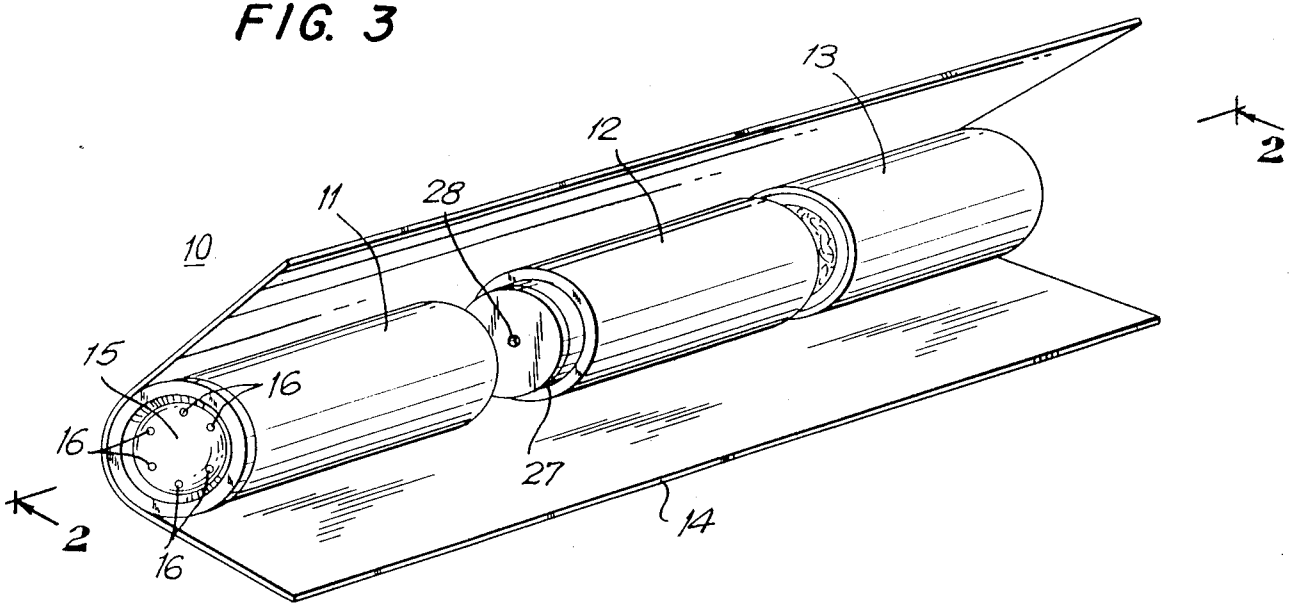
FIG. 3 is an exploded perspective view of an embodiment of a smoking article incorporating the pellets of the present invention.
Figure 4:
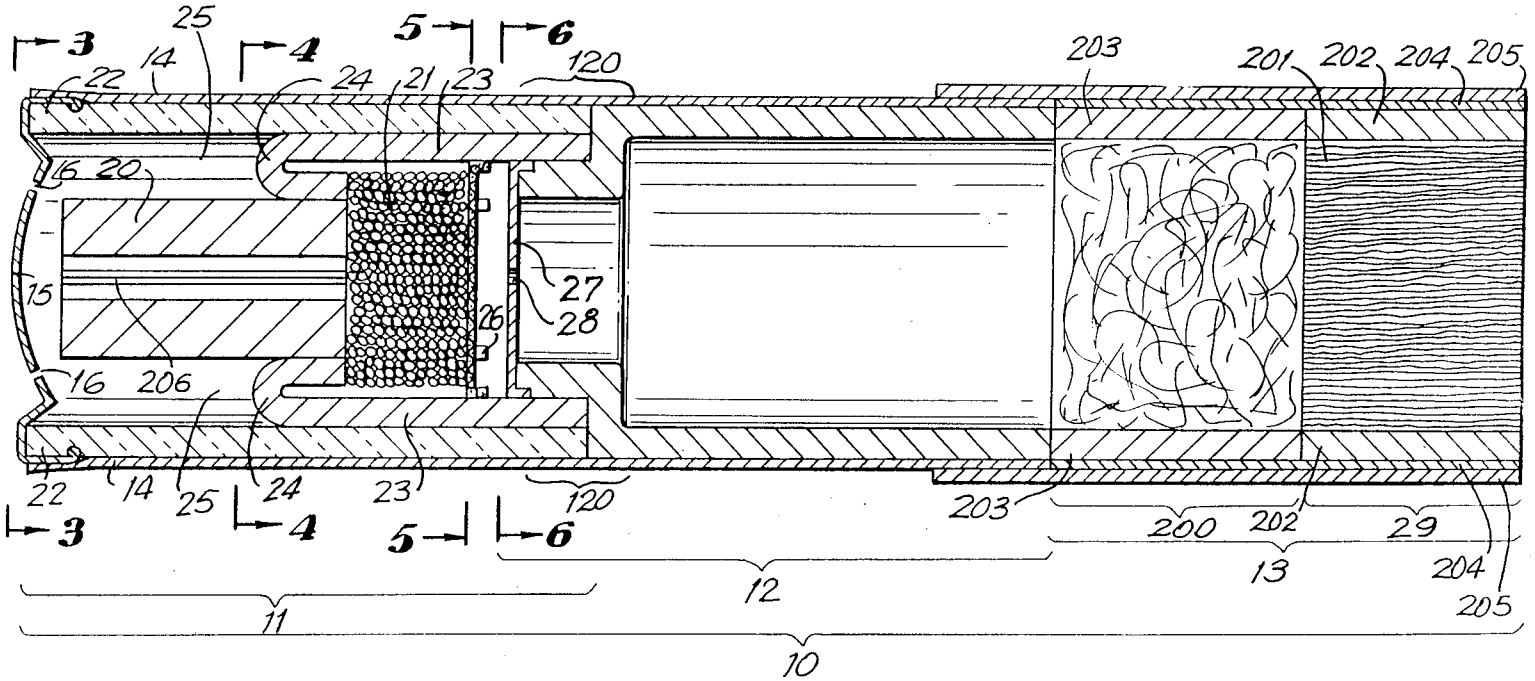
FIG. 4 is a longitudinal cross-sectional view of the smoking article of FIG. 3, taken from line 2—2 of FIG. 3.
Figure 5:
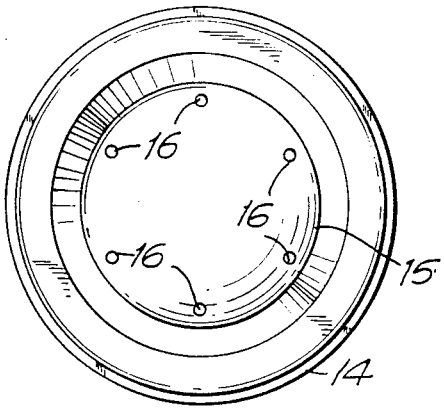
FIG. 5 is an end view of the smoking article of FIGS. 3 and 4, taken from line 3—3 of FIG. 4.
Figure 6:
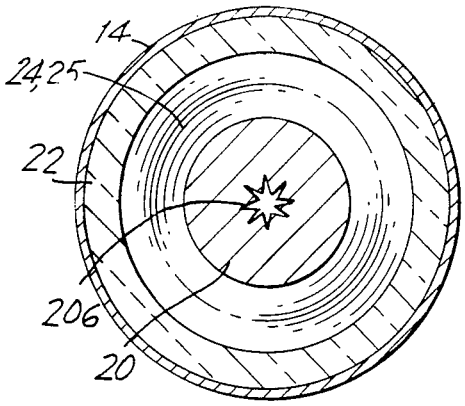
FIG. 6 is a radial cross-sectional view of the smoking article of FIGS. 3–5, taken from line 4—4 of FIG. 4.
Figure 7:
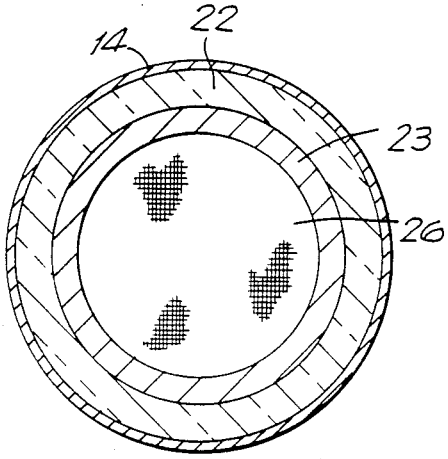
FIG. 7 is a radial cross-sectional view of the smoking article of FIGS. 3–6, taken from line 5—5 of FIG. 4.
Figure 8:
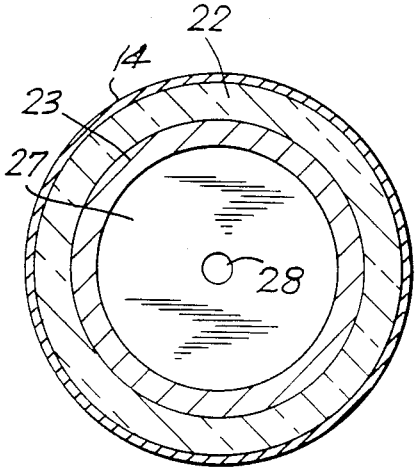
FIG. 8 is a radial cross-sectional view of 390 the smoking article of FIGS. 3–7, taken from line 6—6 of FIG. 4.

Turning to the details of the construction of article 10 insofar as they relate to the present invention, active element 11 is housed in a composite sleeve including an outer sleeve 22 and an inner sleeve 23 within outer sleeve 22. Inner sleeve 23 is folded to provide a lip 24 which holds heat source 20 suspended away from the interior wall of outer sleeve 22, leaving an annular space 25. Chamber 21 is bounded by inner sleeve 23 and between lip 24 and heat source 20 on one end, and a screen-like clip 26, which holds pellets 21 (e.g. pellets 329 as shown in FIG. 2b) in place while allowing the aerosol to pass into spacer tube 12 on the other end. Spacer tube 12 gives article 10 the length, and thus the appearance, of an ordinary cigarette. Wrapper 14 holds active element 11 and spacer tube 12 together. The details of other examples of smoking articles that could use the flavor source of the present invention may be found from European Patent Applications 0 277 355, 0 212 234, and 0 254 848 and U.S. Pat. No. 4,714,082 and U.S. patent application Ser. No. 115,640, and, co-pending U.S. patent application Ser. No. 07/223,153 being filed concurrently herewith.

One skilled in the art will appreciate that the present invention can be practiced by other than the described embodiments, which are presented for purposes of illustration and not of limitation and the present invention is limited only by the claims which follow.

We claim:

1. A thermally releasable flavorant source for use in a smoking article comprising a non-densified mixture of from about 15 to about 95 wt.% tobacco particles having a particle size of up to about 20 mesh, from about 0 to about 50 wt.% filler material particles having a particle size of up to about 100 mesh, from about 0 to about 5 wt.% of a lubricating material, and from about 5 to about 35 wt.% aerosol precursor.

2. The flavorant source of claim 1 further comprising a pellet having a substantially cylindrical configuration.

3. The flavorant source of claim 2 wherein the pellet further comprises a substantially right cylinder having a length that is from about 0.5 to about 1.5 times the diameter of the cylinder.

4. The flavorant source of claim 3 wherein the pellet is from about 0.5 to about 1.5 mm in length.

5. The pellet of claim 2 wherein the aerosol precursor is selected from among the group consisting of glycerine, 1,3-butanediol and propylene glycol.

6. The pellet of claim 2 wherein the filler material is selected from among the group consisting of calcium carbonate and alumina.

7. The pellet of claim 1 wherein the lubricant is selected from among the group consisting of glycerine, water, alcohol, and propylene glycol.

8. A flavor generator for use in a smoking article, said smoking article having a heat source and a mouth end, said flavor generator comprising:

a chamber having a first opening and a second opening, the first and second openings being connected by nonporous material so as to create a flow passageway;

a plurality of non densified pellets comprising a mixture of from about 15 to about 95 wt.% tobacco particles having a particle size of up to about 20 mesh, from about 0 to about 50 wt.% filler material particles having a particle size of up to about 100 mesh, and from about 5 to abut 35 wt.% aerosol precursor; and means for securing the pellets in the flow passageway so that said flow passageway is adapted for fluid communication with said mouth end and said heat source.

9. The flavor generator of claim 8 wherein said chamber is substantially cylindrical having a length in a range from about 10 to about 12 mm and a diameter in a range from about 4 to 7 mm.

10. The flavor generator of claim 8 wherein the plurality of pellets have a mass of from about 100 to about 200 mg.

11. The flavor generator of claim 8 wherein the means for securing the pellets in the flow passageway further provides for fluid flow through the chamber with substantially no pressure drop across the pellets.

12. The flavor generator of claim 8 wherein the pellets further comprise a mixture of from about 40 to about 70 wt.% tobacco particles having a particle size up to about 100 mesh, from about 10 to about 20 wt.% glycerine, and from about 20 to about 30 wt.% calcium carbonate.

13. A method of making a thermally releasable tobacco-containing material for use in a smoking article comprising:

mixing together from about 15 to about 95 wt.% tobacco particles having a particle size of up to about 20 mesh, from about 0 to about 50 wt.% filler material particles having a particle size of up to about 100 mesh, from about 0 to about 5 wt.% of a lubricating material, and from about 5 to about 35 wt.% aerosol precursor;

extruding the mixture through a die to form a strand; and severing the strand into substantially uniform lengths, thereby forming non-densified pellets for use in a smoking article.

14. The method of claim 13 wherein the step of extruding the mixture further comprises extruding the mixture through a die having a plurality of orifices to form a plurality of strands and wherein the severing step further comprises severing the strands into substantially uniform lengths, thereby forming pellets.

15. The method of claim 13 wherein the extruded strand is about 1.0 mm in diameter.

16. The method of claim 13 wherein the step of severing the strand further comprises passing a knife, positioned with the cutting edge in frictional contact with the die orifice, through an extruded strand as the strand is extruded to cut the strand into pellets.

17. The method of claim 13 wherein the step of extruding the mixture further comprises passing the mixture out of the die at a rate of from about 100 to about 250 pounds per hour.

18. The method of claim 13 wherein the step of mixing the components further comprises maintaining the temperature of the mixture of the mixture below about 170° F. prior to extrusion.

19. The method of claim 13 wherein the step of severing the strand further comprises severing the strand into pellets having a substantially cylindrical sectional configuration.

20. The method of claim 19 wherein the step of severing the strand further comprises severing the strand into a substantially right cylinder having a length that is from about 0.5 to about 1.5 times the diameter of the cylinder.

21. The method of claim 20 wherein the cylinder is from about 0.5 to about 1.5 mm in length.

22. The method of claim 19 wherein the step of severing the strand further comprises severing the strand at one of an acute or obtuse angle to the longitudinal axis of the strand.

23. The method of claim 13 wherein the aerosol precursor is selected from among the group consisting of glycerine, 1,3 butanediol, and propylene glycol.

24. The method of claim 13 wherein the filler material is selected from among the group consisting of calcium carbonate and alumina.

25. The method of claim 13 wherein the lubricating material is selected from among the group consisting of glycerine, water, alcohol, and propylene glycol.

26. A flavor generator for use in a smoking article, said smoking article having a heat source and a mouth end, said flavor generator comprising a plurality of pellets made in accordance with the method of claim 13 and means for containing the plurality of pellets in a confined space so that the application of heat to the pellets in the confined space will cause the pellets to generate an aerosol and vapors of flavorants.

27. The flavor generator of claim 26 wherein the means for containing the plurality of pellets further comprises a chamber having nonporous walls forming a flow passageway in fluid communication with the heat source and mouth end.

28. The flavor generator of claim 27 wherein the fluid flow through the chamber has substantially no pressure drop across the pellets.

* * * * *

UNITED STATES PATENT AND TRADEMARK OFFICE

CERTIFICATE OF CORRECTION

PATENT NO. : 4,981,522

DATED : January 1, 1991

INVENTOR(S) : Walter A. Nichols et al.

It is certified that error appears in the above-identified patent and that said Letters Patent is hereby corrected as shown below:

Column 2, line 31, "obJect" should be -- object --; and
line 66, "mixture The" should be
-- mixture. The --.

Column 4, line 49, "up o" should be -- up to --.

Claim 8, column 10, line 10, "abut" should be -- about --.

Signed and Sealed this

Twenty-fourth Day of August, 1993

Bruce Lehman

*Attest:*

BRUCE LEHMAN

*Attesting Officer*

*Commissioner of Patents and Trademarks*